US005203638A

United States Patent [19]

Redmond, Jr.

[11] Patent Number: 5,203,638

[45] Date of Patent: Apr. 20, 1993

[54] WRITING INSTRUMENT FOR ALTERNATELY WRITING IN FLUORESCENT TRANSPARENT AND NONTRANSPARENT INK

[76] Inventor: Robert F. Redmond, Jr., 3900 W. Franklin St., Richmond, Va. 23221

[21] Appl. No.: 800,013

[22] Filed: Nov. 29, 1991

[51] Int. Cl.[5] ..... B43K 27/08

[52] U.S. Cl. ..... 401/17; 401/21; 401/23; 401/35; 401/117; 401/29; 401/202

[58] Field of Search ..... 401/17, 19, 20, 21, 401/23, 29, 31, 32, 34, 35, 202, 102, 117, 99

[56] References Cited

U.S. PATENT DOCUMENTS

| | | | |
|---|---|---|---|
| 746,897 | 12/1903 | Stuart | 401/29 |
| 1,402,164 | 1/1922 | Houser | 401/29 |
| 1,482,054 | 1/1924 | Visitation | 401/29 |
| 1,533,162 | 4/1925 | Chesne | 401/17 |
| 1,534,629 | 4/1925 | Amshen | 401/17 |
| 4,902,151 | 2/1990 | Asano et al. | 401/35 X |
| 5,017,034 | 5/1991 | Stary et al. | 401/35 |

FOREIGN PATENT DOCUMENTS

| | | | |
|---|---|---|---|
| 549218 | 10/1956 | Italy | 401/31 |
| 640179 | 7/1950 | United Kingdom | 401/99 |

*Primary Examiner*—Danton D. DeMille
*Attorney, Agent, or Firm*—Joseph C. Redmond, Jr.

[57] ABSTRACT

A writing instrument comprises nonretractable nib 14 made of porous material and being in fluid communication with an ink reservoir of fluorescent transparent ink, the nib colloquially known as a "highlighter". A second nib 16 is retractable and is substantially rigid and is in fluid communication with a second ink reservoir of nontransparent ink, the second nib colloquially known as a "ball point pen". The retractable and nonretractable nibs extend from an angular face of an elongated body in which they are contained. The angular face permits the nonretractable and retractable nibs, which are in parallel relation, to extend in spaced relations so that the retractable nibs extends beyond the nonretractable nib whereby the nonretractable nib does not contact the writing surface when the retractable nib is used as writing instrument. The extension and retraction of the retractable nib is accomplished with a slidable locking mechanism which allows a user to extend a retractable nib with a single finger motion without altering the writing angle or rotating the instrument in his hand, as in the prior art.

2 Claims, 1 Drawing Sheet

WRITING INSTRUMENT FOR ALTERNATELY WRITING IN FLUORESCENT TRANSPARENT AND NONTRANSPARENT INK

BACKGROUND OF INVENTION

1. Field of Invention

This invention relates to apparatus for forming a continuous line and more particularly to a writing instrument capable of alternately forming lines fluorescent transparent ink and nontransparent ink.

2. Description of Related Art

U.S. Pat. No. 4,580,918 describes a writing instrument for forming lines of different widths, but not fluorescent transparent and nontransparent inks, by first and second nibs which, in one form, the first nib forms a first line width of one color and in the second form combines the first nib with the second nib to form a second width of a same color, both drawing from the same ink reservoir.

U.S. Pat. Nos. 5,017,034 describes a writing instrument having a pair of writing tips which may be of different color and when held at one angle, form a line of a first width and when rotated within the user's hand and held at a second angle, form a line of a second width and color.

Neither of these references solve the problem of a writing instrument that will permit lines using fluorescent transparent ink and nontransparent ink alternately, without forcing the user to rotate the instrument in his hand and change the angle of use.

SUMMARY OF THE INVENTION

The writing instrument of the present invention is a dual purpose writing implement. It consists of one nonretractable nib made of porous material and being in fluid communication with an ink reservoir of fluorescent transparent ink colloquially known as a "highlighter". The second nib is retractable and substantially rigid. It is in fluid communication with a second ink reservoir of nontransparent ink.

A feature of the invention is an elongated body with two nibs, a retractable nib and a nonretractable nib, at the end of said body. The retractable and nonretractable nibs are arranged at an angle that allows the user to form continuous lines using fluorescent transparent ink yet extend the retractable nib to write marginalia when desired. The retractable nib extends beyond the nonretractable nib so that the nonretractable nib does not contact the writing surface. The extension and retraction of the retractable nib is accomplished with a slidable locking button mounted on the forward portion of the elongated body. This method of extension and retraction allows the user to extend the retractable nib with a simple finger motion without altering the writing angle or rotating the instrument in his hand as in prior art.

Another feature of the invention is a cap designed to protect the writing nibs and to insure that the retractable nib is in the retracted position when the instrument is not in use.

DESCRIPTION OF THE PREFERRED EMBODIMENT

Figure 1A:
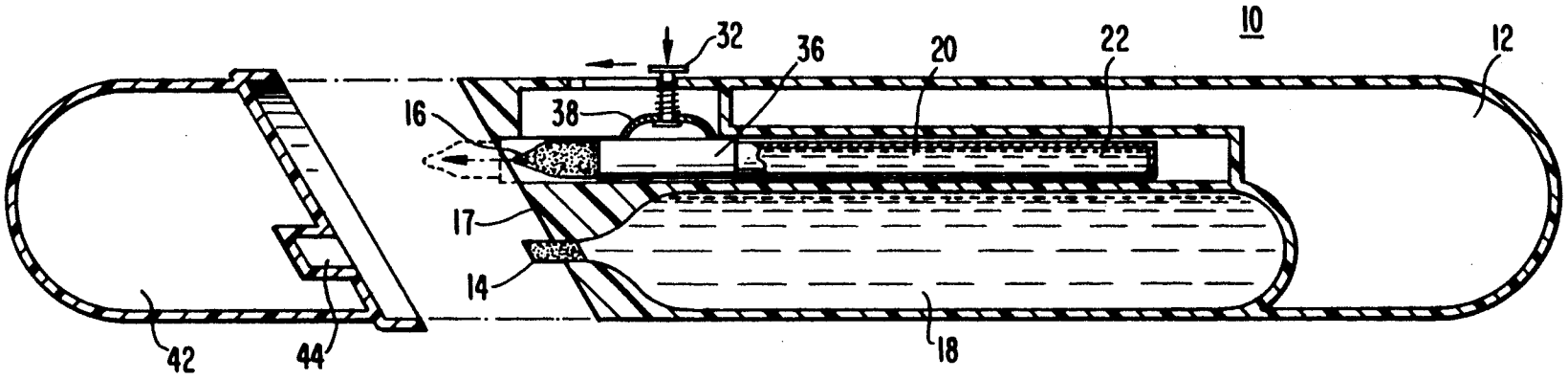
FIG. 1A shows a cross-sectional view of a writing instrument which is the subject of the present invention.
Figure 2B:
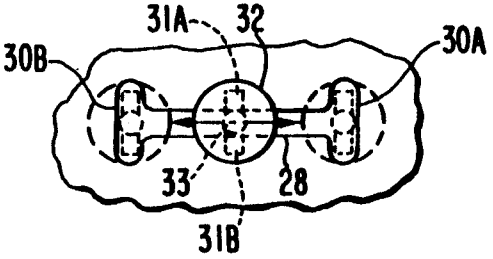
FIG. 2B shows a top view of the slidable locking mechanism in the locked position at each end o the travel path.
Figure 2A:
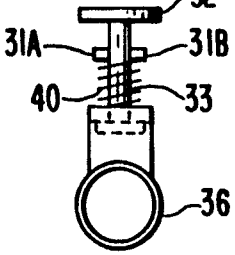
FIG. 2A shows a front view of the slidable locking mechanism.
Figure 1B:
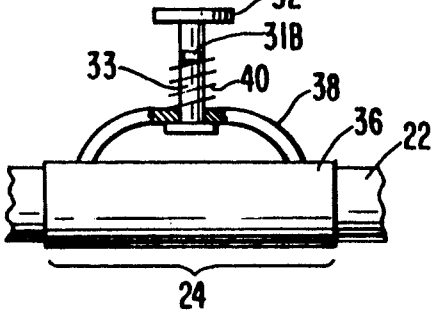
FIG. 1B shows a cross-sectional view of the slidable locking mechanism, further described below.

A writing instrument, 10, for forming continuous lines consists of an elongated body, 12, with two nibs, 14 and 16, at the same end of the elongated body, which end forms an angled surface 17 with respect to the body 12". Each nib draws from a separate ink reservoir, one reservoir, 18, consisting of fluorescent, transparent ink, and the other reservoir, 20, consisting of nontransparent ink.

The retractable substantially rigid nib, 16, is in fluid communication with the reservoir, 20, of nontransparent ink, the barrel, 22, of said retractable nib, 16, being contained within a slidable locking mechanism, 24, which is the method of extension and retraction.

The slidable locking mechanism, 24, in operational communication with the barrel, 22, of the retractable nib, 16, consists of a sleeve, 36, containing the barrel, 22, of the retractable nib, 16, a travel path, 28, locking channels, 30A and 30B, and a spring activated locking button, 32, that inserts into the locking channels, 30A and 30B, at each end of the travel path, 28.

The nonretractable, porous nib, 14, in fluid communication with the reservoir of fluorescent, transparent ink, 18, which nib is arranged in a preselected angle relative to the longitudinal axis of the elongated body ,12, and relative to the extended position of the retractable nib, 16.

The cap, 42, enclosing the end of the elongated body, 12, which cap fully encloses the nonretractable porous nib, 14, in a hole, 44, and can only be emplaced if the retractable nib, 16, is in the retracted position.

The slidable locking mechanism, 24, containing the barrel of the retractable nib, 22, and reservoir of nontransparent ink, 20, consisting of a sleeve, 36, securing said barrel which sleeve is attached to a perpendicular locking button, 32, by an arch, 38, rising from said sleeve, 36, the top of the arch containing a hole which allows the shaft of the perpendicular locking button, 32, to descend below the arch when the locking button is depressed by the user. The sleeve, 36, securing the retractable barrel, 22, contains protrusions on each horizontal axis, (not shown) which insert into grooves in the elongated body, (not shown) and stabilize the retractable barrel during the process of extension and retraction.

The locking button, 32, which consists of a shaft 33 attached to a flattened arch, 38, and perpendicular to said arch, which shaft has at the opposite end an oval corrugated button which protrudes from the outer perimeter of the elongated body, 12, immediately below the oval button are locking protrusions 31A and 31B which insert into the locking channels, 30A and 30B respectively at either end of the travel path, 28. Immediately below the locking protrusions a spring, 40, surrounds the shaft between the locking protrusions and the flattened arch, 38, The spring, 40, is seated on the flattened portion of the arch and provides upward pressure on the locking protrusions allowing them to lock into the locking channels, 30A and 30B.

A travel path, 28, in the elongated body, 12, consisting of two grooves (not shown) which stabilize the slidable locking mechanism, 24, and locking channels, 30A and 30B, at each end of the travel path, 28, which locking channels correspond to the locking protrusions on the locking button, 32.

Whereby when the first nib is retracted the second nib is available for use in forming continuous lines of fluorescent transparent ink and when the retractable nib is extended, it allows the user to form continuous lines of nontransparent ink without allowing the nonretractable nib to contact the writing surface and without causing the user to alter his angle of writing or causing the writer to rotate the instrument in his hand.

While the invention has been described in a specific embodiment it will by understood by those having skill in the art that changes can be made to the specific embodiment without departure from the spirit and scope of the invention.

I claim:

1. A writing instrument, 10, for forming continuous lines capable of writing alternately in fluorescent transparent and nontransparent ink comprising:

i) a first elongated body, 12, having a first nib, 16, and a second nib, 14, at one end of the elongated body;

ii) the first nib, 16, being retractably mounted in the end and being axially aligned with the longitudinal axis of the elongated body, 12;

iii) the second nib, 14, being fixed in the same end and spaced from the longitudinal axis of the elongated body, 12 and extending a length which is different from the extended position of the retractable nib, 16;

iv) the first retractable nib, 16, consisting of a substantially rigid nib in fluid communication with a reservoir on nontransparent ink, 20, which reservoir is held in a barrel, 22, attached to the retractable nib which barrel extends and retracts with the retractable nib;

v) the second nonretractable nib, 14, consisting of a porous nib in fluid communication with a reservoir of fluoresecent transparent ink, 18;

vi) a slidable locking mechanism, 24, for extending and retracting the nib, 16, with a simple finger motion without requiring the user to alter the writing angle or causing the user to rotate the instrument in the hand comprising:

i) a slidable sleeve, 36, containing the barrel, 22, of the retractable nib, 16, which sleeve is attached to a flattened archy, 38;

ii) an arch, 38, rising from the sleeve, 36, which is flattened at it apogee and contains, at its apogee a hole capable of accepting the perpendicular shaft of the locking button, 32, when the shaft is depressed;

iii) a perpendicular shaft, 32, that has, at one end an oval locking button which protrudes from the outer perimeter of the elongated body, 12, of the instrument and at the opposite end is seated slightly above the hole at the apogee of the flattened arch, 38, which end is capable of being depressed through the hole when pressure is exerted on the oval locking button, located on said oval locking button adjacent said perpendicular shaft are locking protrusions;

iv) a spring, 40, surrounding the perpendicular shaft, 32, which spring is seated, at one end, on the flattened portion of the arch, 38, and on the opposite end, on the locking protrusions of the oval locking button, 32, which spring is capable of exerting upward pressure on the oval locking button and the perpendicular shaft, 32, but will compress when the oval locking button is depressed.

2. The writing instrument of claim 1, further including a cap, 42, said cap 42, having an end angled to conform to an angled end of the elongated body, 12, which cap has a hole, 44, designed to contain the nonretractable nib, 14, yet lacking a hole for receiving the retractable nib, 16, so the cap cannot be placed on the instrument unless the retractable nib, 16, is retracted insuring that both nibs are protected when not in use.

* * * * *